United States Patent [19]

Fukumoto

[11] 4,040,148

[45] Aug. 9, 1977

[54] BUTTON FOR CLOTHES

[76] Inventor: Noriyoshi Fukumoto, No. 942 Shimoishihara, Chohu, Tokyo, Japan

[21] Appl. No.: 611,946

[22] Filed: Sept. 10, 1975

[51] Int. Cl.[2] ..... A44B 1/38

[52] U.S. Cl. ..... 24/108; 24/110

[58] Field of Search ..... 24/110, 90 E, 108, 90 PR

[56] References Cited

U.S. PATENT DOCUMENTS

| | | | |
|---|---|---|---|
| 388,212 | 8/1888 | Meyers | 24/90 PR |
| 451,025 | 4/1891 | Chapman | 24/90 PR |
| 488,219 | 12/1892 | Platt | 24/108 |
| 531,466 | 12/1894 | Moore | 24/110 |
| 558,398 | 4/1896 | Lettre | 24/108 |
| 1,193,936 | 8/1916 | Smith | 24/108 |
| 1,204,159 | 11/1916 | Jaffe | 24/108 |
| 1,274,787 | 8/1918 | Rowe | 24/108 |
| 2,308,424 | 1/1943 | Morehouse | 24/110 |

FOREIGN PATENT DOCUMENTS

| | | | |
|---|---|---|---|
| 722,567 | 3/1932 | France | 24/108 |
| 94,992 | 9/1920 | Switzerland | 24/108 |
| 187,580 | 2/1937 | Switzerland | 24/108 |
| 22,305 | 10/1907 | United Kingdom | 24/110 |
| 15,170 | 6/1914 | United Kingdom | 24/108 |
| 779,535 | 7/1957 | United Kingdom | 24/108 |

*Primary Examiner*—Bernard Gelak
*Attorney, Agent, or Firm*—Fred Philpitt

[57] ABSTRACT

A button for clothes is composed of a button body and a reverse button having a needle member as a set. The button body is formed on its base plate center with an axial hole for insertion of the needle member of the reverse button. The inside of the button body is provided with an engaging means for firm engagement of the needle member of the reverse button inserted into the inside through the axial hole and a detaching means for release of engagement of the needle member that is engaged with the button body. The engaging means is formed by an engaging member provided with a ring portion to be retained between the base plate and an ornament member by means of a thin plate member. The ring portion is formed integrally with two pawl pieces which extend diametrically from the ring portion toward the center. Each of the pawl pieces is formed with a semi-circular notch at its respective ends whereby the notches form a circular hole that coincides with the axial hole of the base plate. The detaching means is formed with a through hole at a location where one of the pawl pieces of the base plate is located.

6 Claims, 10 Drawing Figures

BUTTON FOR CLOTHES

BACKGROUND OF THE INVENTION

The present invention relates to a button for clothes and more particularly to a button for clothes formed by an ornament button and reverse button as a set. A needle member is protruded integrally from the reverse button, and when this needle member pierces the clothes simultaneously it is detachably coupled to the ornament button.

Heretofore, the conventional button for clothes is formed with holes for threads and the button is put into place on the clothes by sewing threads through the holes. This work of removing the button or exchanging thereof is not easy and is troublesome work. Therefore even when cleaning of the clothes is to be made by a laundry shop the clothes are cleaned while the buttons are attached, as a result, problems such as fading of the ornament button and adhesion of dyeing agent of the button onto the clothes tend to occur. Also, in recent years the enjoyment of exchanging the ornament button whenever the suit is changed has come into fashion but there is a drawback in that tendency because of the problem involved in the sewing work of the button by the sewing threads.

The present invention has achieved a degree of success in solving the foregoing conventional problems.

SUMMARY OF THE INVENTION

An object of the present invention is to provide a button formed by a button body and a reverse button having a needle member as a set, which eliminates the problem of sewing the button to the clothes by the sewing threads, by fitting the button on the clothes by means of a needle member.

Another object of the present invention is to provide a button for clothes in which an engaging means and a detaching means are provided to simplify remarkably the manipulation of engaging and detaching the needle member of the reverse button to the button body as well as to make the engaging condition positive and firm.

Still another object of the present invention is to provide a button for clothes in which the reverse button and its needle member are integrally formed of a synthetic resin material to provide flexibility to the needle member. Thus the needle member is protected from rusting and also to provide a securing function which is equal to or greater than that of sewing threads.

A further object of the present invention is to provide a button for clothes in which the reverse button and needle member are formed by a synthetic resin material and a spiral steel made elastic member such as piano wire, etc. is built in the center of the needle member to reinforce the elasticity and rigidity of the needle member so as to prevent damage resulting from the breaking of the needle member, and to provide the needle member with a securing function equal or greater than that of the sewing threads by rendering proper flexibility to the needle member.

DETAILED DESCRIPTION OF THE INVENTION

Figure 1:
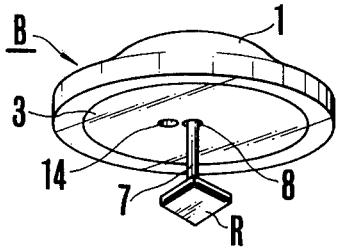
FIG. 1 is a perspective view of the entire button.
Figure 3:
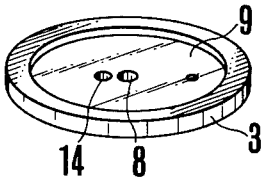
FIG. 3 is a perspective view of a base plate.
Figure 2:
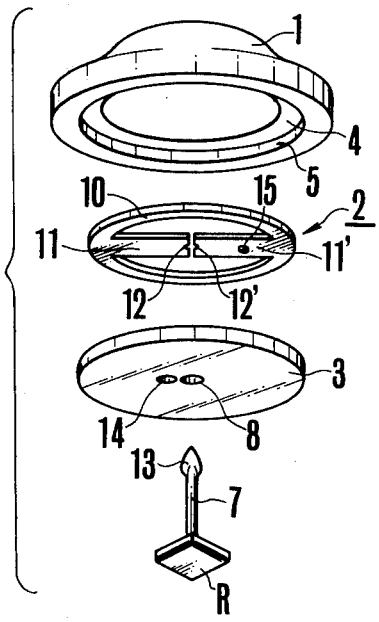
FIG. 2 is a perspective view showing disassembled condition of each member.
Figure 4:
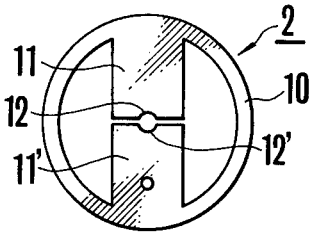
FIG. 4 is a plan view of an engaging member.
Figure 5:
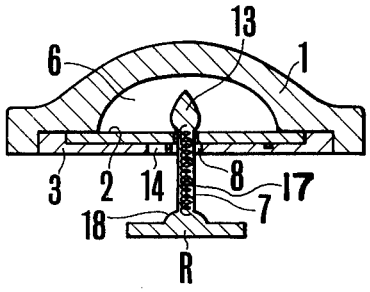
FIG. 5 is a vertical cross sectional view of the button.

A button body according to the present invention is represented by a letter B, and is provided with an engaging means and detaching means for insertion and detachable engagement of a needle member of a reverse button R.

Said button body B is formed by an assembly of an ornament member 1, engaging disc member 2 and a base plate 3. Said ornament member 1 is formed in such a way that its lower surface is open and its inside is hollowed out to shape a dome like cavity. An annular step portion 4 is formed on the inner peripheral side of the opening and also an inner cylindrical portion 5 is formed on its peripheral portion. The base plate 3 is fitted to the inner cylindrical portion 5 formed on the opening of the ornament member 1. The ornament member 1 and the base plate 3 are integrally fixed and an empty chamber 6 is formed by the inner cavity of the ornament member 1 in the upper part of the base plate 3.

On the center of the base plate 3, an axial hole 8 for insertion of a needle member 7 of the reverse button R is formed as a through hole. A concave surface 9 is formed on the upper surface of the base plate 3 and the engaging member 2 is set over the concave surface 9. The engaging member 2 is formed of a thin plate material having flexibility. Preferably, said member shall be made of synthetic resin materials. Said engaging member 2 is formed with a ring portion 10 to be retained by the annular step portion 4 of the ornament member 1 when it is placed on the concave surface 9 of the base plate 3. Pawl pieces 11, 11' are extended toward the center from right and left symmetrical positions of the ring portion 10 and are resiliently placed in the empty chamber 6. The tips of the pawl pieces 11, 11' are opposed to each other at the center portion. The edges of the tip portions are formed with semi-circular notched portions 12, 12' which are mutually symmetrical. A pair of said semi-circular notched portions 12, 12' forms a circular hole at a position where the hole for needle member 7 of the base plate 3 coincides with the circular hole.

The tip portion of the needle member 7 of the reverse button R is formed in an arrowhead portion 13. The hole 8 for needle member 7 formed on the base plate of the button body B is formed to have a diameter sufficient to allow the insertion of the arrowhead portion 13 formed at the tip of the needle member 7 of the reverse button R. Each semi-circular notch portion 12, 12' formed at tips of pawl pieces 11, 11' of the engaging member 2 are formed to have a slightly smaller diameter than that of the axial hole 8 which is a diameter sufficient to permit meshing engagement at the reverse side of the arrowhead portion 13 with the needle member 7 of the reverse button R. When the needle member 7 of the reverse button R is inserted into the axial hole 8 of the base plate, the right and left pawl pieces 11, 11' of the engaging member 2 are pushed up by means of the arrowhead portion 13 of the tip of the needle member 7. After the arrowhead portion 13 is moved into the empty chamber 6 the pawl pieces 11, 11' return to the original positions to engage the neck portion of the arrowhead portion of the needle member 7 by the semi-circular notched portions 12, 12' of the pawl pieces 11, 11', whereby an engaging means is formed.

Figure 6:
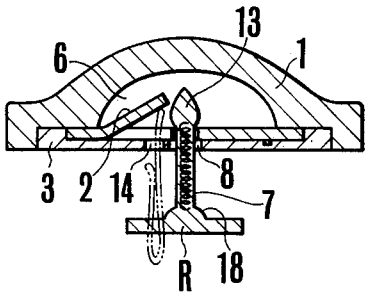
FIG. 6 is a vertical cross sectional view showing the release of engagement by the needle member.

The base plate 3 is formed with a through hole 14 which is adjacent to the axial hole 8 and is positioned where one of the pawl pieces 11 of the engaging member 2 is located. As shown in FIG. 6, the tip of an hair pin is inserted into the through hole 14 to push only one of the pawl pieces 11 to release the engaged condition of the needle member 7 of the reverse button R from the arrowhead portion 13, whereby a detaching means is provided. Also, the other pawl piece 11' is formed with a boss 15 to be engaged with a receiving hole 16 for the boss 15 which is formed on the base plate 3 so that the engaging member 2 is firmly retained on the base plate 3.

In order to provide the securing function to the reverse button R and the needle member 7 which is equal or greater than the function provided by sewing the button on the clothes by means of the sewing threads, the reverse button R and the needle member 7 are molded of synthetic resin material integrally to give the flexibility to said button and member. A spiral steel made elastic member 17 such as piano wire is built in the needle member 7 along the center line of the longitudinal direction to render the resiliency and rigidity to the needle member 7. Moreover a stem portion 18 is formed which bulges over the entire portion of the outer periphery of the stem portion of the needle member 7. When the needle member 7 is pierced into the clothes, breaking of the needle member 7 can be prevented on account of its rigidity. At the same time, in the condition where the button body B is attached on the clothes, the needle member 7 having proper resiliency is capable of obtaining the proper attached condition of the button body B on the clothes by its flexibility and resiliency; namely, securing the condition which is equal or greater than the conditions where an ordinary button is attached to the clothes by sewing threads.

Figure 7:
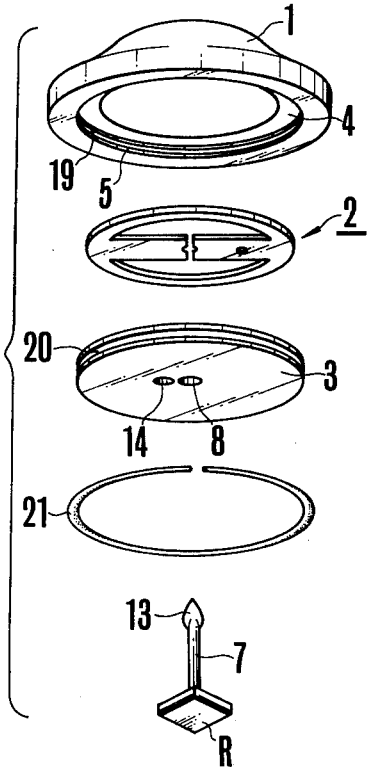
FIG. 7 is a disassembled perspective view showing another embodiment of the present invention.
Figure 8:
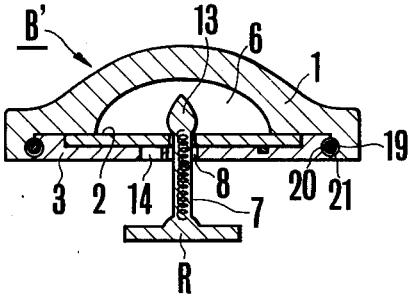
FIG. 8 is a vertical cross sectional view showing the assembled button.

Furthermore, FIG. 7 and FIG. 8 shows another embodiment related to the present invention. The button body B' is constructed in such a way that an annular groove 19 that is formed on the entire periphery of the wall surface of the inner cylindrical portion 5 of an ornament member 1. An annular groove 20 is formed on the entire periphery of an outer side wall of the base plate 3 which corresponds to the annular groove 19 of the ornament member 1. An annular spring 21 is resiliently mounted in the space formed by both the annular grooves 19 and 20, whereby the ornament member 1 and the base plate 3 are fitted. As a result, the ornament member 1 becomes detachable from the base plate 3, and according to seasons, or according to clothes to be worn, the ornament member 1 can be freely exchanged, and thus a person wearing the clothes can enjoy the exchanged ornament button.

Figure 9:
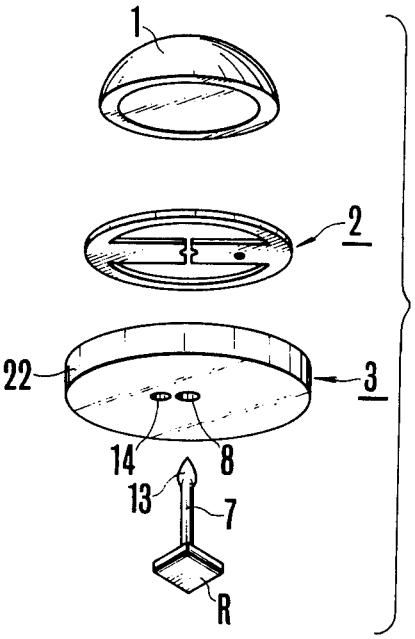
FIG. 9 is a view showing still another embodiment of the present invention.
Figure 10:
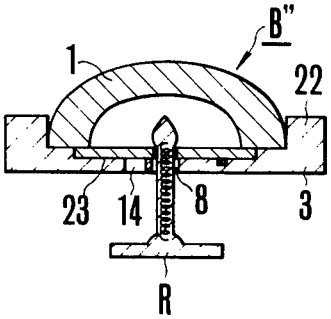
FIG. 10 is a vertical cross sectional view showing the assembled button.

Furthermore, FIG. 9 and FIG. 10 show still another embodiment of the present invension. The button body B'' is constructed in such an upstanding way that a side wall 22 is formed on the outer periphery of the base plate 3. A concave surface portion 23 is formed to install an engaging member 2 on its bottom surface. The ornament member 1 is plugged into the base plate 3 and the ring portion 10 of the engaging member 2 installed on the concave portion 23 of the base plate 3 is sandwiched and fixed by the inner periphery of the lower edge of the ornament member.

Accordingly, the present invention is constructed in such a way that the needle member 7 of the reverse button R is pierced into the clothes and the tip of the needle member 7 is inserted into the axial hole 8 of the button body B. The arrowhead portion 13 of the needle member 7 pushes up pawl pieces 11, 11' of the engaging member 2 by means of an engaging means provided on the button body B. In case the arrowhead portion 13 is inserted until it thrusts through in the upper part of the pawl pieces 11, 11', the pawl pieces 11, 11' return to the original position by the elastic force, namely, to the concave surface 9 of the base plate 3. Thus the needle member 7 is meshed with the semi-circular notched portions 12, 12'. In this condition, when the needle member 7 is pulled out, the pawl pieces 11, 11' are engaged with the arrowhead portion 13 to completely stop the fall out of the needle member 7 so that the needle member 7 is firmly retained by the pawl pieces 11, 11'.

On the contrary, in case of removing the reverse button R from the button body B, the tip of a hair pin, etc. is inserted into the through hole 14 of the base plate 3 by means of a detaching means provided on the button body B, only one of the pawl pieces 11 is lifted resiliently upward, and the meshing with the needle member 7 is released and the needle member 7 of the reverse button R can be pulled out from the button body B. Therefore, the attachment and detachment of the button on the clothes can be easily performed, and particularly, the present invention can prevent such problems as where the dye of a high class button fades or a dye of the button is adhered to the clothes.

Furthermore, the needle member 7 of the reverse button R is made of synthetic resin material which gives flexibility to the needle material and elasticity and rigidity are rendered to the needle member 7 as it has a built in spiral steel made elastic member 17 provided inside of the needle member 7. With this arrangement, breaking of the needle member 7 can be prevented when it is pierced into the clothes, and also it is possible to fit the button body B on the clothes in the securing condition equal to or greater than thereof where the sewing threads is used. And, the synthetic resin material has no problem of causing rusts even if it is used for a long period of time, and also can be provided at low cost.

I claim:

1. A button for clothes comprising in combination: a button body and a reverse button as a set; said reverse button having an integrally formed needle member and an arrowhead portion formed protrudely at the tip of the needle member; said button body formed by an ornament member having an inside cavity with a bottom opening and a base plate; said base plate having an axial hole for insertion of the needle member and being formed in the center of the base plate as a through hole; said base plate having a concave surface formed on its upper surface to place an engaging disc member on the concave surface; said engaging member formed of a thin plate material having resiliency including a ring portion to be retained by the base plate at the lower edge of the ornament member and an engaging means for engaging the needle member inserted in the axial hole of the base plate; said engaging means being formed of a pair of pawl pieces extending toward the center from the right and left symmetrical positions of the ring portion; said pawl pieces being opposed to each other at their tip portions to form a circular hole by semi-circular notched portions of the tip portions; said needle member inserted into the axial hole of the base plate; said engaging means being such that the diameter of the axial hole of the base plate is sufficient to allow the insertion of the arrowhead portion of the needle member of the reverse button; said circular hole formed by said semicircular notched portions of said two pawl pieces of the engaging member being made to coincide with the axial hole of the base plate; said circular hole being made to have a slightly smaller diameter as compared with that of the axial hole of the base plate; said circular hole diameter being sufficient to effect meshing engagement at the reverse side of the arrowhead portion of the needle member; said base plate being formed with a through hole and being provided with a detaching means for removing the reverse button engaged on the button body, and said detaching means being such that the through hole being formed at a position where one of the pawl pieces of the engaging member is located and also a position closer to the tip of said pawl piece.

2. A button for clothes as defined in claim 1 in which the button body is formed by an assembly of the ornament member, the engaging member and the base plate, and said ornament member has an annular step portion formed on the inner peripheral side of the bottom opening to form an inner cylindrical portion, the base plate is fitted on the inner cylindrical portion of the ornament member so as to be integrally fixed and the ring portion of the engaging member provided on the concave surface of the base plate is retained and fixed by the annular step portion of the ornament member.

3. A button for clothes as defined in claim 1 in which the button body is formed by an assembly of the ornament member, the engaging member and the base plate, and said ornament member has an annular step portion formed on the inner peripheral side of the bottom opening to form an inner cylindrical portion, an annular groove is formed on the wall surface of the inner cylindrical portion, the base plate is formed with an annular groove on its outer peripheral side wall which corresponds to the annular groove formed on the inner cylindrical portion of the ornament member, an annular spring is mounted resiliently in both the annular grooves, the base plate is fitted on the inner cylindrical portion of the ornament member so as to be detachable, and the ring portion of the engaging member provided on the concave surface of the base plate is retained and fixed by the annular step portion of the ornament member.

4. A button for clothes as defined in claim 1 in which the button body is formed by an assembly of the ornament member, the engaging member and the base plate, and the base plate having an upstanding side wall protrudedly on its outer periphery the ornament member is fitted adjacent the side wall of the base plate, and the ring portion of the engaging member installed on the concave surface of the base plate is retained and fixed by the inner periphery of the lower edge of the ornament member.

5. A button for clothes as defined in claim 1 in which the reverse button is integrally molded with the button body and the needle member which are made of synthetic resin material.

6. A button for clothes as defined in claim 1 in which the reverse button is molded with the button body and the needle member which are made of synthetic resin material, and a spiral steel made elastic member is built in the needle member along the center line of the longitudinal direction of the needle member.

* * * * *